US009056659B2

(12) United States Patent
Adair

(10) Patent No.: US 9,056,659 B2
(45) Date of Patent: Jun. 16, 2015

(54) SOLAR POWERED ILLUMINATED BOAT CLEAT

(71) Applicant: Herman N. Philhower, as Trustee of the H N Philhower Family Trust (last dated October 31, 2012), Cypress, CA (US)

(72) Inventor: Robin Charles Adair, Huntington Beach, CA (US)

(73) Assignee: Herman N. Philhower, Cypress, CA (US), as Trustee of the H N Philhower Family Trust Last Dated 10/31/2012.

( * ) Notice: Subject to any disclaimer, the term of this patent is extended or adjusted under 35 U.S.C. 154(b) by 0 days.

(21) Appl. No.: 14/151,817

(22) Filed: Jan. 10, 2014

(65) Prior Publication Data

US 2014/0196652 A1 Jul. 17, 2014

Related U.S. Application Data

(60) Provisional application No. 61/752,958, filed on Jan. 15, 2013.

(51) Int. Cl.
*B63B 21/04* (2006.01)
*B63B 45/00* (2006.01)

(52) U.S. Cl.
CPC ..... *B63B 45/00* (2013.01); *B63B 21/045* (2013.01); *B63B 2201/08* (2013.01); *B63B 2209/18* (2013.01)

(58) Field of Classification Search
USPC ..... 114/218
IPC ..... B63B 21/045
See application file for complete search history.

(56) References Cited

U.S. PATENT DOCUMENTS

| | | | | |
|---|---|---|---|---|
| 8,025,431 | B1 * | 9/2011 | Burke | 362/391 |
| 2012/0017817 | A1 * | 1/2012 | Martzall | 114/218 |
| 2012/0313661 | A1 * | 12/2012 | Jungwirth et al. | 324/761.01 |
| 2013/0076269 | A1 * | 3/2013 | Shilton | 315/360 |

* cited by examiner

*Primary Examiner* — Stephen Avila
(74) *Attorney, Agent, or Firm* — Curtis L. Harrington; Harrington & Harrington

(57) ABSTRACT

The boat cleats of the invention are typically mounted on the watercraft and docks adjacent to the water for tying watercraft to piers as well as to other watercraft and disclose a solar powered modular structure supported within a boat cleat mechanical housing support structure. This arrangement provides savings associated with the provision of through-the-dock wiring access, easy removability for replacement, maintenance and servicing, and which is sealed against the environment. The self contained solar powered modular structure may have communications capabilities to enable distributed control and sensing.

14 Claims, 7 Drawing Sheets

SOLAR POWERED ILLUMINATED BOAT CLEAT

Continuation of Provisional Patent No. 61/752,958 filed Jan. 15, 2013.

FIELD OF THE INVENTION

The present invention relates to improvements in the field of dock mounted support structures for providing stable support and for providing illumination in a manner that is low maintenance and with automatic operational service, and which will provide benefits to boat owners and dock managers by providing a constant night time illumination without the need for wiring.

BACKGROUND OF THE INVENTION

Dock mounted support structures, sometimes referred to as cleats, may typically be a pair of opposite projections supported above the surface of a dock or deck. Boats are moored to docks and piers utilizing boat cleats which may be more often mounted to docks, piers, but may even be found mounted to boat decks. Conventional boat cleats normally do not provide any means of lighting and if some form of lighting is supplied, such as adjacent to the cleat, such lighting is required to be hooked up to power mains. Powering any form of lighting via the power mains will involve a power distribution network and possibly through-dock drilling either for the lighting or for the path of the power distribution cord, as any such power distribution must be kept out of the way. Maintenance is also an issue, including both the maintenance and inspection of the power distribution system, but also of maintaining the light sources. Maintaining the light sources usually involves access to the inside of a lighting device and the requirement to perform maintenance one unit at a time along the dock's edge.

Many variations of cleat structure and orientation are possible, but the usually seen boat cleats are mounted to be parallel with cantilevered arms of the cleats generally oriented in serial parallel and along the edge of a structure that provides mooring of and easy access to a boat. On long runs of dock, cleats are typically mounted parallel with and adjacent an edge of the dock where a boat is likely to be moored.

Even absent all other considerations, conventional cleats are somewhat of a necessary hazard. A typical cleat must have enough of an upward projection above the dock to enable a rope to be wrapped around it multiple times (typically with the last few loops ending in a criss-cross fashion). Mounting a cleat either partially or fully below deck level would be difficult and impractical. As a result the necessary upward projection is a stumbling and tripping hazard, especially in low light. This hazard is particularly severe at the intersection between dock and boat, at positions where it is usual to board and leave the vessel.

Further, even ignoring the pedestrian factor, boat operations can require a quick tie-up to the dock, particularly when the crew doesn't carry personal lighting, or when flashlight handling would impair the ability of crew members to handle the lines. This circumstance can be especially challenging where a dock area lacks lighting is approached at night. Even if the cleats cannot be seen, they must be located in order to be engaged with lines. Where not viewable, and in absolute darkness the crew may toss a line blindly at the dock hoping to snag a cleat or some other damage resistant structure.

SUMMARY OF THE INVENTION

The present invention provides for an illuminated boat cleat that has a number of advantages over conventional nonlighted cleats as well as cleats which are specially installed and wired for energization by the power mains. First, by eliminating the need to connect to power mains, a corresponding savings is experienced by eliminating the need to provide shielded access to power distribution under harsh environmental (exposure to moisture and salt) conditions, as well as the savings associated with the provision of through-the-dock wiring access which involves drilling holes and aligning access to lighting structures.

Second, by providing a solar powered modular structure as described herein (which may be simply a modular structure although referred to as a solar powered modular structure to more fully illustrate the structure shown). The solar powered modular structure is preferably easily removable from a boat cleat housing, easy access to removability is obtained, and disassembly of the lighting unit on-site is not necessary. The lighting modules will preferably be self-contained and will simply lift out of the cleat structure. Security against vandals and thieves can be provided by securing the module within the cleat structure with fasteners which range from ordinary screw driver operated threaded members to unusual engagement and locking members requiring special tools, especially in large-scale facilities.

Third, the self contained solar powered modular structure can be sealed against the environment. Because it can be manufactured in a controlled, off-site environment, it can have a greater assurance of being sealed. The risk of field service inconsistencies in environmental sealing are well known and assured control of sealing is cost-sensitive. Further, where the self contained solar powered modular structure has communications capabilities, any monitoring or checking or diagnostic polling can be performed without the need to access the sealed unit.

Further, modularization enables advantages for a facility in ease of both technology upgrading and user function differentiation. For example, in a large dock facility, the same types of modules can be changed out in groups to allow for keeping only a small inventory of replacement modules which can either be repaired on site or shipped offsite for repair. In the case where upgrading of all modules is desired, all modules can be replaced with new ones with the replaced modules either refurbished, upgraded, and or sold on the secondary market to another facility. In addition, where an owner or manager decides that illuminated cleats are no longer needed, the modules may simply be removed to leave a standard-use cleat structure which can be used in the conventional way, but with the added advantage that the dock or siding owner may decide to re-introduce the electrical modules at any point in the future, especially where a technological improvement or capability encourages the owner or manager to do so.

Differentiation is possible such as where it is desired to replace every other module is a different color, or to place modules having additional capability at different locations interspersed in between other modules to cause some cleats to have different functions. Some of those functions might include signaling from the cleat module or to the cleat module. Such signaling could be either initiated or limited or restricted using a central communication station.

The examples of the reasons and types of communication and signaling are endless. A central station may be used to changed the light color of several cleat modules along a siding where a boat may have obtained permission to dock. In another instance a series of lights adjacent a boat slip may be made to flash where the renter needs to contact the port authority. Special flashing sequences may be used at night to silently or with audio, signal time such as some flashing at times similar to those of a bell tower clock.

Control need not be had exclusively from a central station but can be shared with local devices. A boat owner may have the ability to, either through a central system or through a local wireless control, turn his illuminated cleats on or off. Control through a central system may partially include a link through the internet. In addition, the self contained solar powered modular structures can be enabled to communicate with each other. For example, a catastrophic failure in a unit such as complete destruction by a heavy piece of equipment, would not result in an ability to report its status. An adjacent cleat unit might report a failure, especially if the solar powered cleat units were set to communicate with each other more often than a central station.

The "drop in" accommodating nature of the cleat structure which accommodates the self contained solar powered modular structures enables a wide variety of other physical variations. For some cleats it may be desirable to have a taller and brighter light source under certain circumstances, such as special events or where specialized structures are needed in cleat locations for which a higher profile structure is acceptable. The interchange of one solar powered modular structure for another, such as the self contained solar powered modular structure being interchanged for any other structure, may be preferably performed by unfastening and refastening a threaded member. The change-out can be performed with an electric rotary tool, such as an electric screwdriver, in about 5-10 seconds.

In terms of the nature and quality of the light produced, as well as the time of duration during which lighting is activated, the solar powered illuminated boat cleat self contained solar powered modular structures can either be pre-set with a timer or controlled remotely to turn on and off at different times. A timer may set itself from the passing of a threshold level of light and dark, and it might also determine the intensity and color of light which is displayed. By example only, a self contained solar powered modular structure might be set to start its timer at dusk and to thereafter burn brightly with a white light until midnight, and then dim itself and switch to a red light illumination at midnight.

The individualized programming can be done by electromagnetic or optical signal through the self contained solar powered modular structure to optimize in accord with the needs of the facility. The control of the cycle and illumination needs of the dock facility provides for a measure of safety and convenience. For example, docks and piers are potentially dangerous places to walk because of reduced visibility. Containers, equipment, cargo, ropes, chains and other items are deposited on piers further making walking on dark piers dangerous. The edge or edges of a pier are often where boat cleats are mounted and these areas are usually free of obstructions that could hinder access to or from a watercraft or that could prevent people from falling into the water. The Solar Powered Illuminated Boat Cleat of the invention provides ease of locating the edge of the dock or pier and provides a measure of safety for pedestrians in the boat harbor as well as within the boat.

Boat cleats are attached to the edges of both piers and decks to receive lines and secure watercraft to piers. Because these cleats are typically on the edge of piers as well at other watercraft, which by design are adjacent to the water, they are convenient for indicating a location relative to the water as well as potential danger to pedestrians. Even where the solar powered illuminated boat cleat is engaged with a securing rope, significant light can still be transmitted to surrounding areas.

During daylight hours and periods of good visibility, boat cleats are easy to see and clearly indicate the location of a boundary that should not be crossed unintentionally. During periods of darkness and periods of poor visibility it is difficult or even impossible to see the cleats. When the cleats cannot be seen, a person could trip on them and fall. A person could also walk off the edge of a pier or the side of a watercraft if a restraining system is not provided. A solar powered illuminated boat cleat system provides for easy visibility to address the concerns for safety and providing the helmsman an easy way to determine the location of the boat cleat.

Other advantages include: (1) the solar powered illuminated boat cleat can be lighted, especially over shorter periods depending upon its energy storage, as a lamp; (2) can be easily found when at night; (3) can be used for a decoration for docks and boats, such where it installed with colorful LED capability; (4) it also can be used as a warning light, such as when a boat sails in at night; (5) it can be installed with yellow LEDs and given the capability to flash, not only for a warning but also to reduce duty cycle and (6) it's an environmentally friendly product, requiring no expenditure on power resources, as the solar powered illuminated boat cleat just gets its power from sun.

A preferred embodiment of the solar powered illuminated boat cleat is waterproof and also preferably of the type that may be attached to the deck of a boat or other watercraft. From the discussions above it can be appreciated that an illuminated boat cleat would be beneficial as mounted on watercraft and would enable much more sophisticated communications control onboard a vessel.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
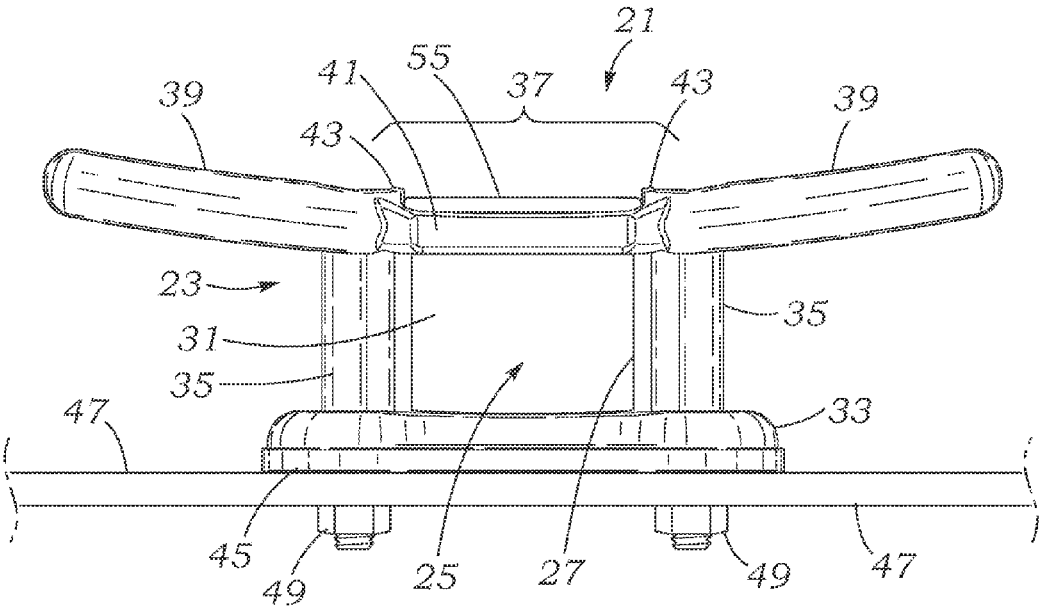
FIG. 1 is a plan view looking into the side of a first embodiment of the subject solar powered illuminated boat cleat of the invention and is shown mounted to a structure which may be a boat dock or other plate.

Referring to FIG. 1, a plan view looking into the side of a solar powered illuminated boat cleat 21 is shown. The solar powered illuminated boat cleat 21 seen in FIG. 1 includes a boat cleat mechanical housing support structure 23 and a solar powered modular structure 25 which is seen through a rectangular opening 27 of the boat cleat mechanical housing support structure 23. The element of the solar powered modular structure 25 that is seen is lens 31 through which electromagnetic radiation may pass, both to illuminate and to communicate with outside entities. Lens 31 may be an integral part of an envelope which forms a waterproof protective sealed containment envelope around any electronic components carried within the solar powered modular structure 25.

A preferred embodiment of the solar powered illuminated boat cleat 21 may include a boat cleat mechanical housing support structure 23 fabricated out of aluminum, although other materials may be utilized, such as die cast aluminum, cast iron, brass, stainless steel, as well as a high strength injection moldable plastic such as Nylon with a fiberglass fill element.

Boat cleat mechanical housing support structure 23 may have a base 33 and a number of vertical structures 35 arising from the base 33 which demark a center section 37. The vertical structures 35 may be a single structure, a pair of structures, or more than a pair of structures, but will preferably demark and provide a space into which the solar powered modular structure 25 may be accommodatably fit and be protectably supported. The tops of the vertical structures 35 each may be continuous with an associated one of the cantilevered arms 39 which is shown extending away from the center section 37 in opposite directions. The two cantilevered arms 39, provide for securing the lines from the watercraft to the solar powered illuminated boat cleat 21. A left cantilevered cleat arm 39 is seen extending from the center section 37 and a similar right cantilevered cleat arm 39 extending from the center section 37, both preferably integral with the center section are provided to secure the lines from the boat to the solar powered illuminated boat cleat 21. The cantilevered arms 39 may be also attached to each other at the top of the vertical structures 35 by a frame section 41. It may also be preferable for the cantilevered arms 39, vertical structures 35, frame section 41 and base 33 to be molded, joined or cast as one integral unit.

Also partially seen above the vertical structures 35 are the upper parts of two hex bolts 43, one each seen above and extend through each of the vertical structures 35. The upper area of each junction between the cantilevered arms 39 and frame section 41 includes an accommodating impression (not seen in FIG. 1) into which the heads of the two hex bolts 43 rotationally lockably fit so that attachment by such hex bolts 43 may be accomplished without having to hold the opposite end of the hex bolts 43 from the end being tightened.

At the center bottom of FIG. 1, underneath the base 33, a seal 45 is seen. The seal 45 provides for an added level of waterproofing to seal out the water from beneath the solar powered illuminated boat cleat 21. Below the seal 45, a planar support structure 47 is seen as representing a dock, deck, pier plank, or other generally planar surface over which the solar powered illuminated boat cleat 21 is to be mounted. Below the planar support structure 47, a pair of nuts 49 are seen, with each nut 49 attached to a corresponding one of the two hex bolts 43.

The center section 37 utilizes two hex bolts 43 that go through the outer part of the center section 37 and provide a holding structure to secure the solar powered illuminated boat cleat 21 to the planar support structure 47 or dock by way of the hex nuts 47. The mounting bolts 43 of sufficient length to allow the use of an optional backing plate (not shown) that would go under the dock or planar support structure 47 can provides for an added level of waterproofing to seal out the water from the assembly which may originate underneath the planar support structure 47.

The pair of nuts 49 may be hex nuts and may threadably secure the hex bolts 43 against the boat cleat mechanical housing support structure 23 to cause the base 33 of the boat cleat mechanical housing support structure 23 to compress the seal 45 between the base 33 and planar support structure 47 to help seal out water and other contaminants from entering below the base. Seal 45 can be solid with accommodation holes for the two hex bolts 43 or may be in the form of an apertured ring depending upon materials and other factors present, but will preferably have an outer periphery slightly exceeding the outer periphery of the base 33 to insure good sealing to help keep out moisture and debris.

At the center top of FIG. 1, a solar cell cover 55 is partially seen only slightly rising above the frame section 41. The solar cell (not specifically shown in FIG. 1) underneath the solar cell cover 55 is mounted within the center section 37 where the light from the lighting sources (not explicitly shown in FIG. 1) may be visible through the lens 1. The solar cell cover 55 and the lens 31 may be parts of an integrated part of an envelope which forms a waterproof protective sealed containment envelope around any electronic components carried within the solar powered modular structure 25. Such an a waterproof protective sealed containment envelope may form a "drop-in" housing which will constitute the unitary solar powered modular structure 25 which will fit within a central accommodation area and which may preferably enter the solar powered illuminated boat cleat.

The area within which the unitary solar powered modular structure 25 will stably reside is generally indicated by the direction of the arrow pointing within the rectangular opening 27 discussed above. It is preferable for the unitary solar powered modular structure 25 to be secured with smaller securing structures which are independent of the mechanical securing structures for the solar powered illuminated boat cleat 21 such as the two hex bolts 43 and pair of nuts 49 so that change-out of the unitary solar powered modular structure 25 can be accomplished without dislodging the boat cleat mechanical housing support structure 23 in any way from the planar support structure 47.

The preferably unitary solar powered modular structure 25 will stably be supported within the volumetric area between the two vertical structures 35 by its own weight and thus only relatively weak threaded members or other structures (not shown) will be needed to hold it in and minimally protect against theft. The reverse side of the solar powered illuminated boat cleat 21 may have a lens 31 and the ability to project light out of the other side of the solar powered illuminated boat cleat 21. Note that a wide number of different types of solar powered modular structure 25 can be selected and employed within the solar powered illuminated boat cleat 21. If controllability is achievable, it is possible to operate to produce light out of the opposite lenses 31 at different times and different colors as may be needed, especially if remote computer or central station control is achievable.

Figure 2:
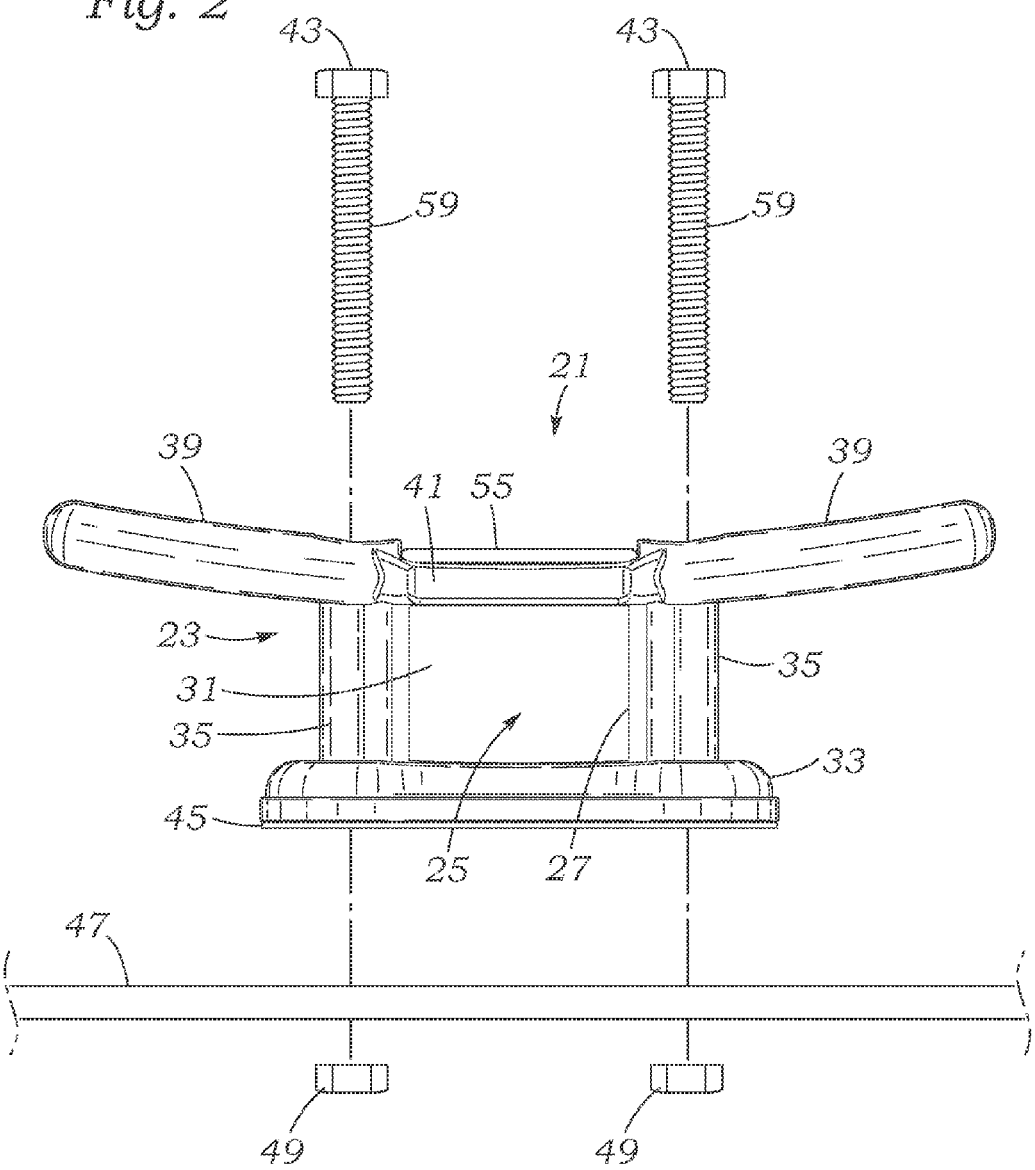
FIG. 2 is a partially exploded side view of the subject solar powered illuminated boat cleat seen in FIG. 1 and showing further details of how the cleat is mounted to a boat dock.

Referring to FIG. 2, a partially exploded side view of the subject solar powered illuminated boat cleat seen in FIG. 1 shows further details of how the cleat is mechanically mounted to a boat dock or planar support structure 47. The seal 43 may be available loose, or it may have some form of attachment to the bottom of the base 33. The two hex bolts 43 have threads 59 which are visible in FIG. 2. The pair of nuts 49 are shown exploded and separate from the planar support structure 47. The seal 45 is simply shown as being connected or associated with the base 33.

The solar powered illuminated boat cleat 21 is disclosed that provides for mounting the dock or the watercraft through the center section 37 and that provides for a bottom surface of the base 33 to be supported and bolted to the dock. The solar powered illuminated boat cleat 21 will be mounted in a position with respect to the planar support structure 47 of a dock such that the illuminated light provided by the light sources will provide a warning of potential danger and indicates the location of the solar powered illuminated boat cleat 21 boat cleat in poor lighting conditions. Just as it is advisable to utilize low beams when driving in fog the quality of light provided by the boat cleat mechanical housing support structure 23 is ideal as high intensity lighting in poor conditions makes locating conventional boat cleats difficult. As such the lighting provided by the boat cleat mechanical housing support structure 23 in poor conditions is advantageous and provides for a level of safety suggested in a waterfront location in which it is employed.

Figure 3:
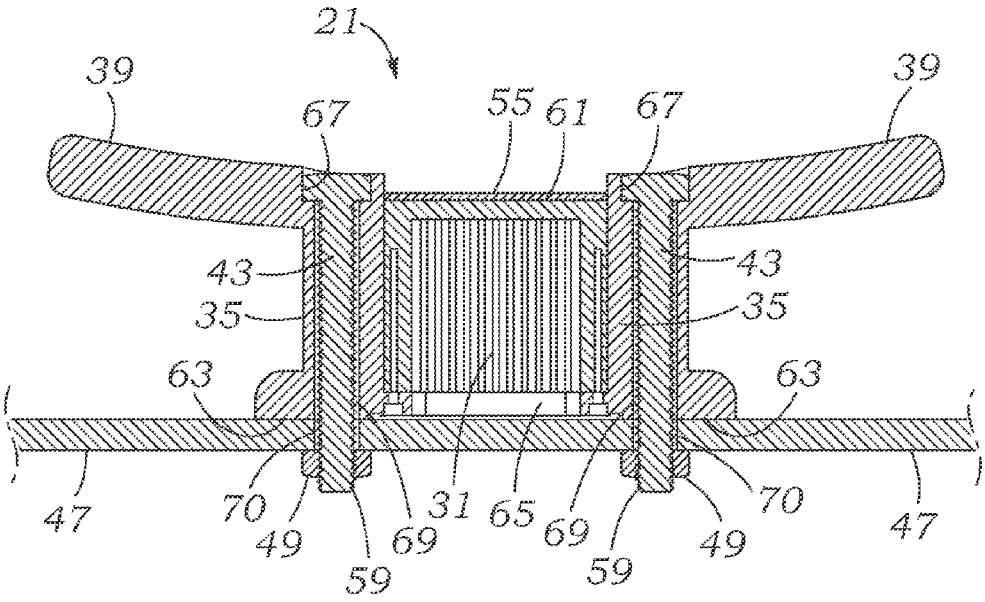
FIG. 3 illustrates a cross sectional side view of the solar powered illuminated boat cleat as seen in FIGS. 1 and 2 to further illustrates the mechanical details thereof and to give an extent of the self contained solar powered modular structure within the boat cleat mechanical housing support.

Referring to FIG. 3, a cross sectional side view of the solar powered illuminated boat cleat 21 as seen in FIGS. 1 and 2 is shown to further illustrate the mechanical details thereof and to give an extent of the self contained solar powered modular structure within the boat cleat mechanical housing support. FIG. 3 shows a cross section side view of the solar powered illuminated boat cleat 21 mounted to planar support structure 47 or a boat dock or other cleat supporting structure. The center section 37 is shown in a manner that provides for the use of two hex bolts 43 that go through the vertical structures 45 of center section 37 and through a bottom mounting surface 63 shown without the seal 45 to allow securing to the to planar support structure 47 or dock, by operation of the hex nuts 49.

Underneath the solar cell cover 55, a solar cell 61 is mounted within the center section 37 where the light from the lighting sources may be generated and visible through the lens 31. The two cantilevered arms 39, provide for securing the lines from a watercraft to the solar powered illuminated boat cleat 21. A battery holder 65 may be seen near the bottom mounting surface 63. The battery holder 65 is mounted low so as not to obstruct or interfere with any of the internals at a level associated with outputting of light or generating of electrical power. Bolt head engagement depressions 67 are seen which engage the hex heads of the two hex bolts 43, and bores 69 are shown extending through the vertical structures 35 to accommodate the bolts 43. Further, a corresponding set of apertures 70 in the planar support structure 47 to enable the bolts 43 to pass through and engage the boat cleat mechanical housing support structure 23 to the planar support structure 47.

Figure 4:
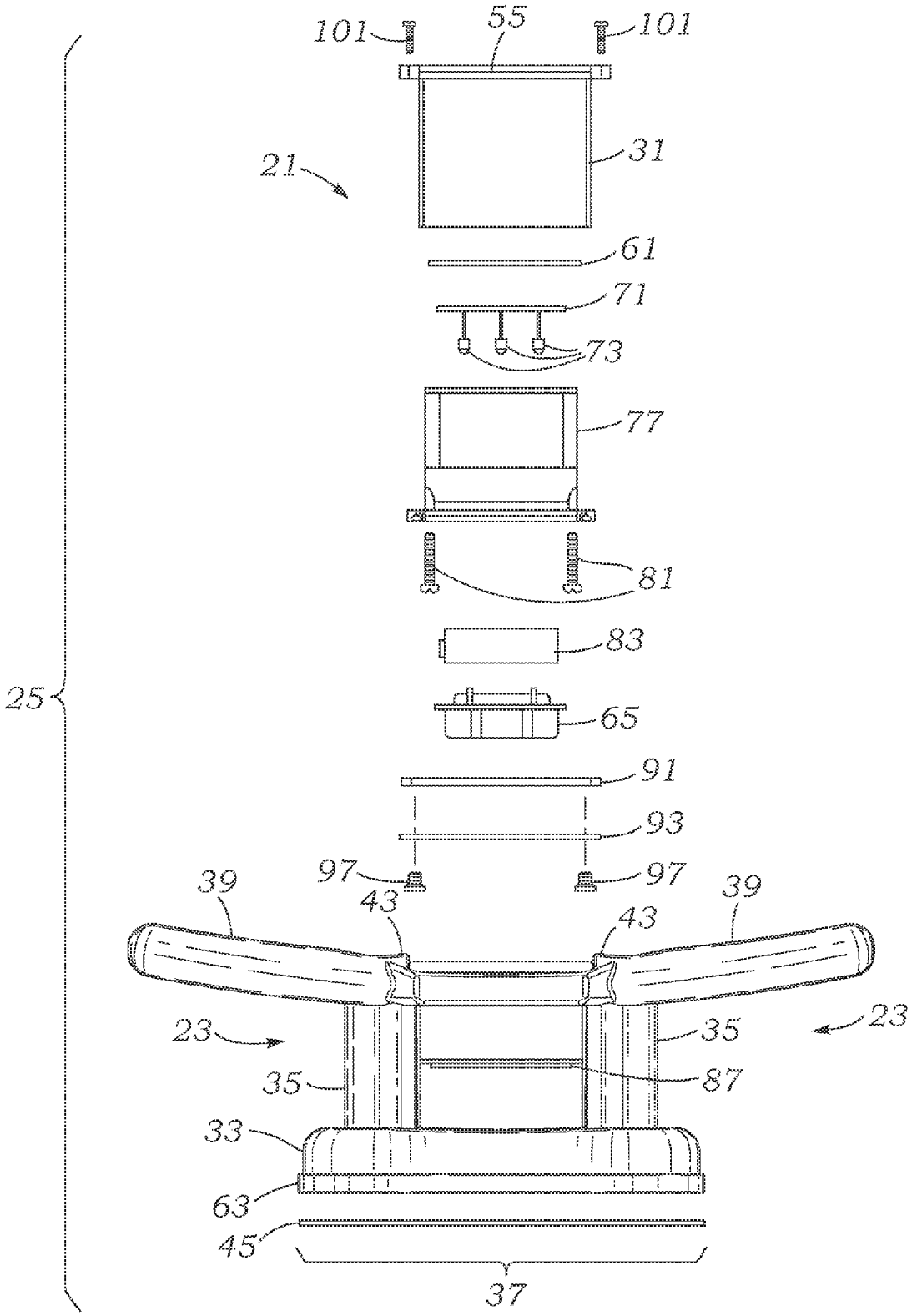
FIG. 4 illustrates a more fully exploded view of the solar powered illuminated boat cleat as seen in FIGS. 1-3 and shows an exploded side view of the solar powered illuminated boat cleat mechanical housing support as well as an exploded view of the self contained solar powered modular structure that resides within the boat cleat mechanical housing support.

Referring to FIG. 4, a view which illustrates a more fully exploded view shows an exploded view of the solar powered illuminated boat cleat 21 boat cleat mechanical housing support 23 as well as an exploded view of the self contained solar powered modular structure 25 that resides within the boat cleat mechanical housing support. Lens 31 is shown above the solar cell 61 and above an electronic circuit board 71 supporting a number of light emitting diodes (LEDs) 73. Electronic circuit board 71 fits within structures associated with a reflector 77 (preferably made of plastic) which helps to disperse light as well as to provide reflective return of any light that impinges upon the reflector 77 such as from a vehicle.

The envelope which forms the solar powered modular structure 25 can be integrally formed of a number of types of components, including lens 31, reflector 77 (which may be a fresnel lens or other light directing structure), solar cell cover 55, battery holder 65, or any other structure or combination of structures. The point of the envelope which forms the solar powered modular structure 25 is to integrate any needed structures into a waterproof, sealed envelope.

A pair of screws 81 are provided to secure the lens 31 and electronic circuit board 71 together. A rechargeable battery 83 is seen which may be an AA 1.2 volt 2000 mAH Ni-MH battery. Battery 83 and silicone rubber gasket 87 are shown above the plastic battery holder 65 that is sealed with another silicone rubber gasket ring 91 with a battery lid 93 securable with screws 97. As shown, a top set of securing screws 101 can secure the assembled solar powered modular structure 25 within the boat cleat mechanical housing support structure 23. Where the securing screws 101 have unusual locking heads, the assembled solar powered modular structure 25 will be more secure within the boat cleat mechanical housing support structure 23 and less subject to tampering.

The assembled solar powered illuminated boat cleat 21, with the silicon rubber gasket rings 87 and 91 as well as the seal 45 provides for an added level of waterproofing to seal out the water and provides for a waterproof rating of IP68 that is desired in waterfront applications. Within FIG. 4 is the base unit, namely a battery 83, a reflector structure 77, a circuit board 71 with various circuits and which support LED lights 73 and a solar cell 61. Any number of other circuits can be supported on the circuit board 71 including communications electronics which includes microprocessors, receivers and transmitters, clocks and timers, displays viewable through any part of the lens 31, photocells for turning the LEDs 73 on and off based upon the level of ambient light, sound creation devices including buzzers and speakers, and more.

Figure 5:
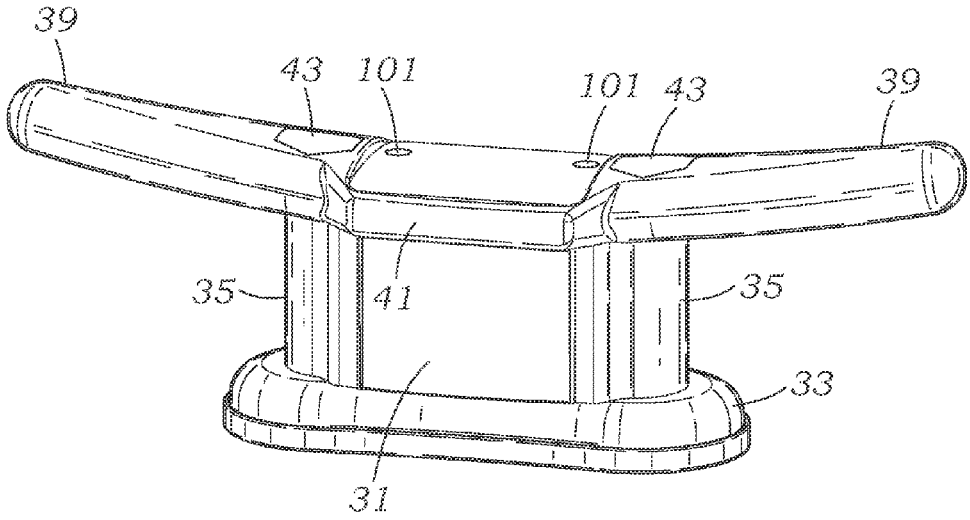
FIG. 5 is a perspective view of the of the solar powered illuminated boat cleat as seen in FIGS. 1-4 and illustrates the fasteners that hold the self contained solar powered modular structure in place.

Referring to FIG. 5, a perspective view of the first embodiment of the solar powered illuminated boat cleat as seen in FIGS. 1-4 better illustrates an overall view and illustrates the fasteners that hold the self contained solar powered modular structure in place. The a top set of securing screws 101 are seen as being set apart from the hex bolts 43. This means that the solar powered illuminated boat cleat 21 cannot be removed from the top, but only that the solar powered modular structure 25 may be able to be accessed. Securing screws 101 will preferably be made of stainless steel and will preferably have a security structure at the top to limit the ability of a passer-by or casual tool possessor from dislodging the solar powered modular structure 25.

Figure 6:
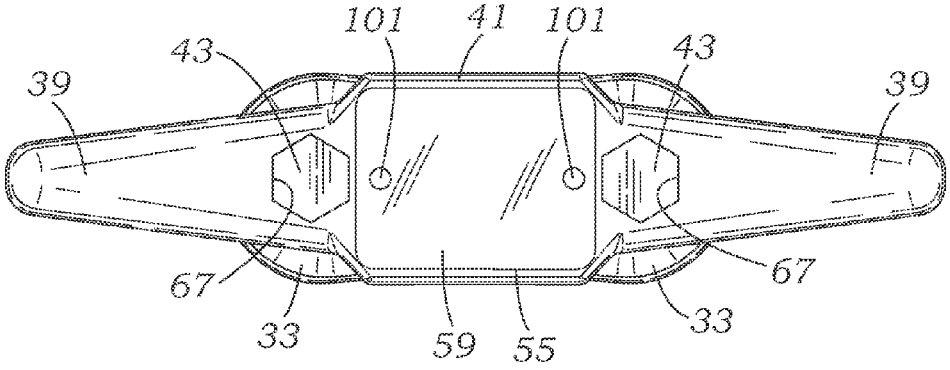
FIG. 6 is a top view of the of the solar powered illuminated boat cleat as seen in FIGS. 1-5 and illustrates further details of the solar powered modular structure and upper hex bolts.

Referring to FIG. 6, a top view of the of the solar powered illuminated boat cleat as seen in FIGS. 1-5 is shown and illustrates further details of the solar powered modular structure and upper hex bolts. Seen clearly for the first time are depressions 67 (hexagonal) into which the hexagonal heads of the hex bolts 43 fit. In this configuration, the boat cleat mechanical housing support structure 23 can only be removed by accessing the pair of nuts 49 on the underside of the planar support structure 47. Solar powered illuminated boat cleat 21 may have an overall dimension as measured between the tip ends of a pair of cantilevered arms 39 of about twelve inches, a height of about four inches, and a width of about two and three quarter inches.

Figure 7:
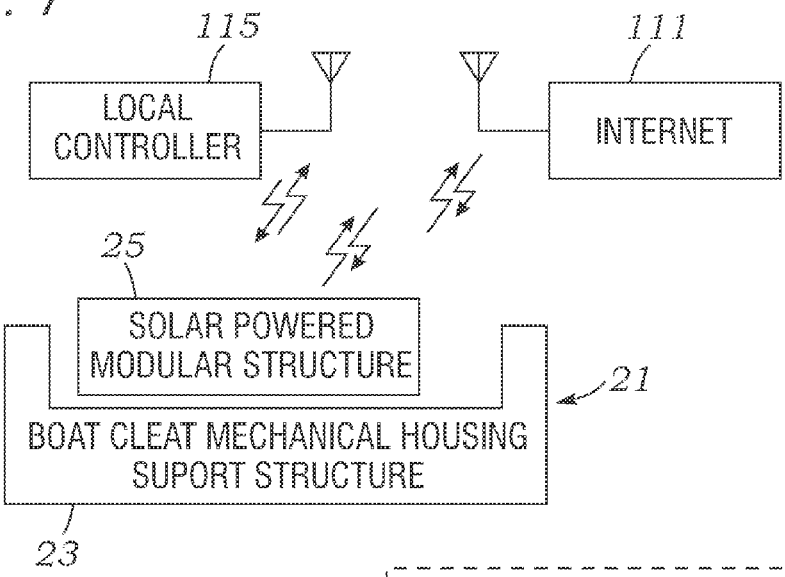
FIG. 7 is a block diagram illustrating one possible realization of the relationship between a communicating solar powered illuminated boat cleat and a wireless connection to the internet as well as a wireless connection to a local controller.

Referring to FIG. 7, a block diagram illustrating one possible realization of the relationship between a solar powered illuminated boat cleat 21 having communicating function is shown. The boat cleat mechanical housing support structure 23 is shown as supporting the solar powered modular structure 25 and a wireless connection to the INTERNET 111 as well as a wireless connection to a LOCAL CONTROLLER 115. Two way communication is indicated by the bi-directional lightening bolts. Communication can be by radio wave, digital wave or light link or any other means of communication.

In the case of the INTERNET 111, a user can control all of the solar powered illuminated boat cleat 21 under a local area network (LAN). The LOCAL CONTROLLER 115 can be either a direct control from a user's LAN system, such as a lap top, or a dedicated hand-held device can be used to perhaps partially control the solar powered illuminated boat cleats 21 to which the user has control capability. As by example, a harbor master may have control rights to all solar powered illuminated boat cleat 21 in the harbor. However, a boat owner may be given control, subject to the overriding control of the harbor master, of solar powered illuminated boat cleats 21 adjacent his dock space.

Figure 8:
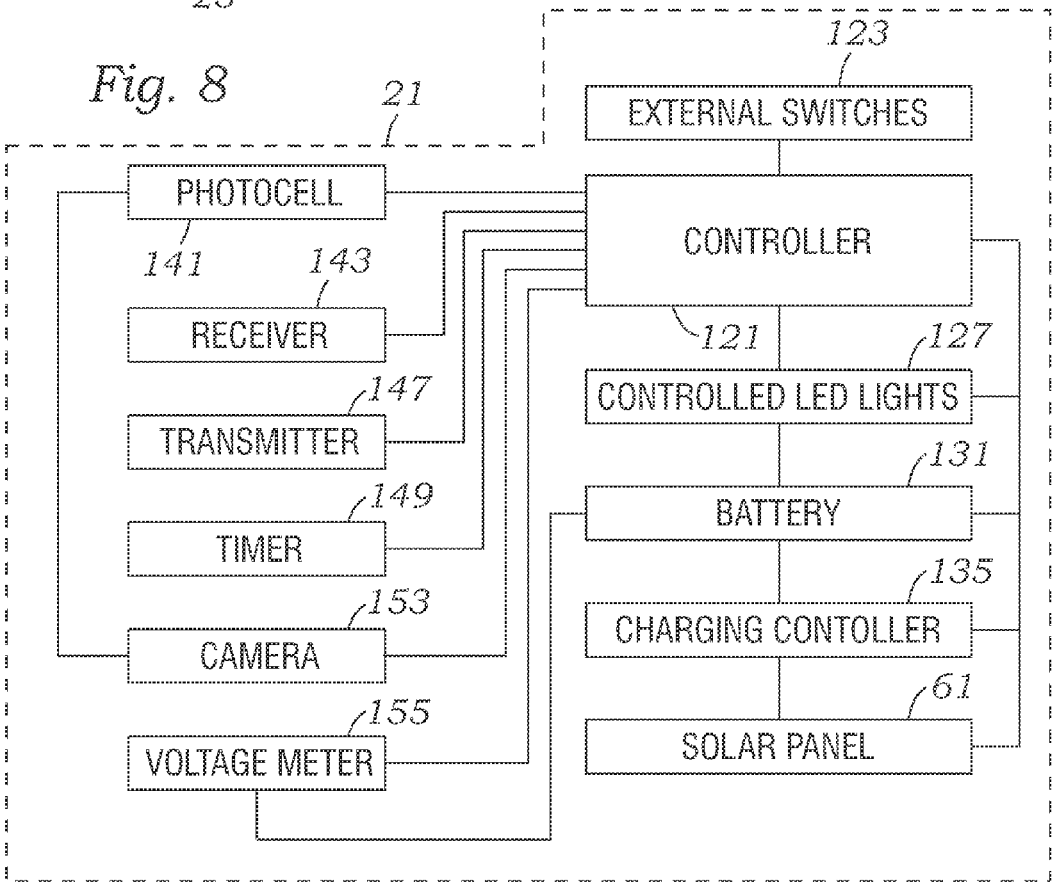
FIG. 8 is a block diagram illustrating one possible realization of the internal circuitry within the solar powered illuminated boat cleat to include a light controller connected to controlled lights, battery, charging controller and solar panel, and also connected to a photocell, receiver, transmitter, timer and voltage meter, with the voltage meter also being connected to the battery.

Referring to FIG. 8, a block diagram illustrating one possible realization of the internal circuitry within the solar powered illuminated boat cleat 21 is shown. Solar powered illuminated boat cleat 21 may include a CONTROLLER 121 which may be referred to as a light controller, and may or may not be connected to EXTERNAL SWITCHES 123. CONTROLLER 121 may be connected to a set of CONTROLLED LIGHTS 127, a BATTERY 131, a CHARGING CONTROLLER 135 and the SOLAR PANEL 61. In addition, the CONTROLLER 121 may also be connected to a PHOTOCELL 141, a RECEIVER 143, a TRANSMITTER 147, a TIMER 149 AND a VOLTAGE METER 155, with the VOLTAGE METER 155 also being connected to the BATTERY 131.

Referring to FIG. 8, a block diagram illustrating one possible realization of the internal circuitry within the solar powered illuminated boat cleat 21 is shown. Solar powered illuminated boat cleat 21 may include a CONTROLLER 121 which may or may not be connected to EXTERNAL SWITCHES 123. CONTROLLER 121 may be connected to a set of CONTROLLED LIGHTS 127, a BATTERY 131, a CHARGING CONTROLLER 135 and the SOLAR PANEL 61. In addition, the CONTROLLER 121 may also be connected to a PHOTOCELL 141, a RECEIVER 143, a TRANSMITTER 147, a TIMER 149, a CAMERA 153, and a VOLTAGE METER 155, with the VOLTAGE METER 155 also being connected to the BATTERY 131.

EXTERNAL SWITCHES 123 can be best realized where they can be sealed against environmental conditions and where the operation by unauthorized persons is not a problem. EXTERNAL SWITCHES 123 may be a slide switch, a magnetically activated switch, or the like. The RECEIVER 143, and TRANSMITTER 147 can be used for communicating any data gathered from any of the CONTROLLER 121, EXTERNAL SWITCHES 123, CONTROLLED LIGHTS 127, BATTERY 131, CHARGING CONTROLLER 135, SOLAR PANEL 61, PHOTOCELL 141, RECEIVER 143, TIMER 149, a CAMERA 153, and VOLTAGE METER 155, and the RECEIVER 143 can communicate instructions to the CONTROLLER 121 to control or query the blocks shown in FIG. 7.

Wireless communications with the solar powered illuminated boat cleat 21 can be via electromagnetic communication including wireless and optic messaging, pager frequencies, telephonic communication by dial tone or digital encoding, or via a computer by jacked or other contact hookup. The solar powered illuminated boat cleat 21 may preferably include an IP68 waterproof rated solar powered center lighting system utilizing LED's or an EL display with a solar powered battery charging system to support the systems of FIG. 8 and may use the PHOTOCELL 141 to turn on and off the CONTROLLED LIGHTS 127 based on the ambient lighting conditions.

The CONTROLLER 121 may be provided that allows a user to turn the CONTROLLED LIGHTS 127 on and off utilizing any input and may provide a change in the color of the light, a blinking function or an emergency signal function. These features may be contained by access to different types of LEDs 73 or within the LEDs 73 and/or other light producing components.

Figure 9:
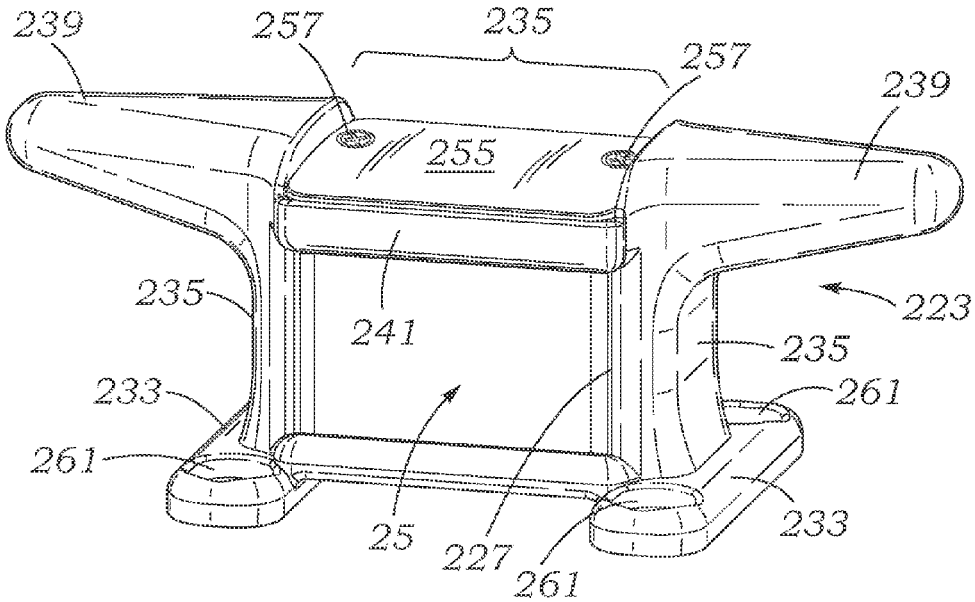
FIG. 9 is a perspective view of a second embodiment of the solar powered illuminated boat cleat of the invention which may typically be a smaller version with seen in FIGS. 1-4 and illustrates a base foot attachment and avoiding the center section mounted hex bolt attachment.

Referring to FIG. 9, a perspective view of a second embodiment of the solar powered illuminated boat cleat of the invention which may typically be a smaller version, is shown as a solar powered illuminated boat cleat 221 and having a boat cleat mechanical housing support structure 223. Solar powered illuminated boat cleat 221 may utilize the same solar powered modular structure 25 with the same or greater capabilities than heretofore described. Solar powered illuminated boat cleat 221 may have a rectangular opening 227 adjacent a lens 31 of the solar powered modular structure 25. A pair of bases 233 each support a vertical structure 235. The vertical structures 235 demark a center section 237 between them which may contain the solar powered modular structure 25. The upper area of the vertical structures 235 naturally turn outward into a pair of cantilevered arms 239. A frame section 41 connects the pair of cantilevered arms 239. In between the frame section 41 and pair of cantilevered arms 239, a solar cell cover 255 is seen. Solar cell cover 255 may be integral with the solar powered modular structure 25. A pair of threaded members 257 are seen securing the solar cell cover 255 and possibly the solar powered modular structure 25 with respect to the boat cleat mechanical housing support structure 223. The pair of bases 233 are each seen as having a pair of spaced apart chamfered apertures 261 which are partially seen in FIG. 9.

Figure 10:
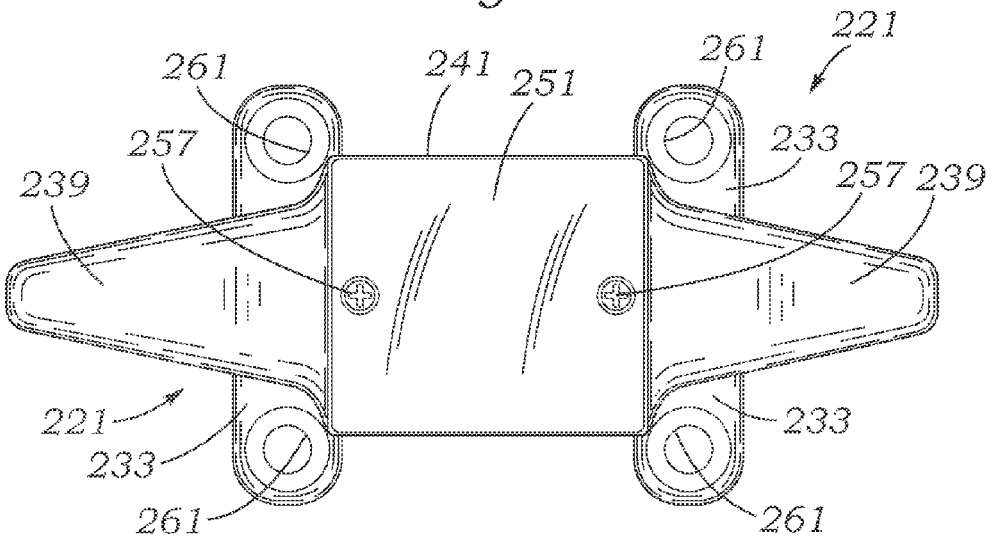
FIG. 10 is a top view of the solar powered illuminated boat cleat as seen in FIG. 9.

Referring to FIG. 10, a top view of the solar powered illuminated boat cleat 221 as seen in FIG. 9 shows further spatial details. The location of the chamfered apertures 261 with respect to the pair of bases 233 can be better understood. The second embodiment of the solar powered illuminated boat cleat 221 may preferably have an overall dimension as measured between the tip ends of the pair of cantilevered arms 239 of about eight inches, a width of the outermost point of the bases 233 of about three and three quarters inches, and an overall height of about three inches.

Invention: The term "invention" is used herein merely to relate to the inventive idea that is the subject of this Provisional patent application to refer to the "concept" being presented. The term "invention" shall not be construed to mean the "literal and legal" translation of the term "invention"; instead it shall pertain to the "concept" being presented. When this Provisional patent application is claimed as preference for the future non-provisional patent application then the term "invention" shall be taken at full face value of the "literal and legal" translation of the term. The term "invention" is used herein merely to relate to the inventive idea that is the subject of this Provisional patent application to refer to the "concept" being presented. The term "invention" shall not be construed to mean the "literal and legal" translation of the term "invention"; instead it shall pertain to the "concept" being presented. When this Provisional patent application is claimed as preference for the future non-provisional patent application then the term "invention" shall be taken at full face value of the "literal and legal" translation of the term.

IP-68: We shall refer to IP-68 to mean "waterproof" as defined by the International Protection Rating classifies and rates the degree of protection provided against the intrusion of solid objects (including body parts like hands and fingers), dust, accidental contact, and water in mechanical casings and with electrical enclosures. The 6 refers to No ingress of dust; complete protection against contact. The 8 states that the equipment is suitable for continuous immersion in water under conditions which shall be specified by the manufacturer. Normally, this will mean that the equipment is hermetically sealed. However, with certain types of equipment, it can mean that water can enter but only in such a manner that it produces no harmful effects.

It is contemplated that any optional feature of the inventive variations described may be set forth and claimed independently, or in combination with any one or more of the features described herein. Reference to a singular item, includes the possibility that there is a plurality of the same items present. More specifically, as used herein and in the appended claims, the singular forms "a," "an," "said," and "the" include plural referents unless specifically stated otherwise. In other words, use of the articles allow for "at least one" of the subject item in the description above as well as the to be appended claims. It is further noted that the to be appended claims may be drafted to exclude any optional element. As such, this statement is intended to serve as antecedent basis for use of such exclusive terminology as "solely," "only" and the like in connection with the recitation of claim elements, or use of a "negative" limitation.

Without the use of such exclusive terminology, the term "comprising" in the to be appended claims shall allow for the inclusion of any additional element irrespective of whether a given number of elements are enumerated in the to be appended claim, or the addition of a feature could be regarded as transforming the nature of an element set forth in the to be appended claims. Except as specifically defined herein, all technical and scientific terms used herein are to be given as broad a commonly understood meaning as possible while maintaining to be appended claim validity.

The breadth of the present invention is not to be limited to the examples provided and/or the subject specification, but rather only by the scope of the to be appended claim language. Use of the term "invention" herein is not intended to limit the scope of the to be appended claims in any manner. Rather it should be recognized that the "invention" includes the many variations explicitly or implicitly described herein, including those variations that would be obvious to one of ordinary skill in the art upon reading the present specification. Further, it is not intended that any section of this specification (e.g., the Summary, Detailed Description, Abstract, Field of the Invention, etc.) be accorded special significance in describing the invention relative to another or the to be appended claims. All references cited are incorporated by reference in their entirety. Although the foregoing invention has been described in detail for purposes of clarity of understanding, it is contemplated that certain modifications may be practiced within the scope of the claims.

What is claimed:

1. A solar powered illuminated boat cleat further comprising:

a boat cleat mechanical housing support attachable to a support structure, the boat cleat mechanical housing support having a center area;

a solar powered modular structure which can be selectively attachably contained within the center area independent of attachability of the boat cleat mechanical housing support attachability to a support structure and wherein the solar powered modular structure further comprises:

a waterproof envelope for support within the boat cleat mechanical housing;

a battery contained within the envelope;

a solar cell contained within the envelope and operatively connected to charge the battery;

a plurality of light sources contained within the envelope and operably connected to the battery; and a photocell connected to at least one of the solar cell and the at least one light source to enable operation of the plurality of light sources contained within the envelope when ambient light falls below a predetermined threshold.

2. The solar powered illuminated boat cleat as recited in claim 1 and wherein the solar powered modular structure further comprises a local controller operably connected to the battery and operatively connected to the at least one light source contained within the waterproof envelope to control the at least one light source contained within the waterproof envelope.

3. The solar powered illuminated boat cleat as recited in claim 2 and wherein the solar powered modular structure further comprises a voltage meter operably connected to the battery and operably connected to the controller contained within the waterproof envelope to enable control of the at least one light source contained within the envelope based upon a voltage level of the battery.

4. A solar powered illuminated boat cleat comprising:

a boat cleat mechanical housing support attachable to a support structure, the boat cleat mechanical housing support having a center area;

a solar powered modular structure which can be selectively attachably contained within the center area independent of attachability of the boat cleat mechanical housing support attachability to a support structure and wherein the solar powered modular structure further comprises:

a waterproof envelope for support within the boat cleat mechanical housing;

a battery contained within the envelope;

a solar cell contained within the envelope and operably connected to the battery;

a plurality of light sources contained within the envelope and operatively connected to the battery; and, a transmitter and receiver operatively connected to the battery and operably connected to the at least one light source contained within the waterproof envelope to control the at least one light source contained within the waterproof envelope.

5. The solar powered illuminated boat cleat as recited in claim 4 and wherein the a boat cleat mechanical housing support attachable to a support structure further includes at least a pair of vertical structures, and a pair of oppositely oriented cantilevered arms each cantilevered arm supported adjacent an associated one of the pair of vertical structures.

6. The solar powered illuminated boat cleat as recited in claim 5 and wherein the a boat cleat mechanical housing support includes a base supporting the vertical structures.

7. The solar powered illuminated boat cleat as recited in claim 5 and wherein the at least a pair of vertical structures each contains a bore for accommodating bolts passing through the vertical structures for the purpose of enabling bolting of the boat cleat mechanical housing support to a support structure.

8. The solar powered illuminated boat cleat as recited in claim 7 and wherein each bore includes a bolt head engagement depression adjacent a connection of a cantilevered arm to an associated support structure.

9. The solar powered illuminated boat cleat as recited in claim 5 and wherein the cantilevered arms have a tapering shape.

10. The solar powered illuminated boat cleat as recited in claim 4 and wherein the a boat cleat mechanical housing includes an opening between the at least a pair of vertical structures and generally parallel to the pair of oppositely oriented cantilevered arms, and through which the solar powered modular structure can transmit light.

11. The solar powered illuminated boat cleat as recited in claim 10 wherein the a boat cleat mechanical housing include two openings through which the solar powered modular structure can transmit light.

12. The solar powered illuminated boat cleat as recited in claim 2 and comprising a transmitter and receiver operably connected to the battery and operatively connected to the local controller and programmed to control the at least one light source contained within the waterproof envelope and to communicate with other solar powered illuminated boat cleat.

13. A solar powered illuminated boat cleat control system comprising the solar powered illuminated boat cleat as recited in claim 12 and wherein the illuminated boat cleat is a plurality of boat cleats each having an associated local controller, and further comprising:

a main controller in controllable communication with each local controller of each of the plurality of boat cleats wherein the main controller controls and receives information from each local controller of each of the plurality of boat cleats.

14. A solar powered illuminated boat cleat control system as recited in claim 13 above and wherein each solar powered illuminated boat cleat further comprises a voltage meter operably connected to the battery and operably connected to the controller contained within the waterproof envelope to enable transmission of information relating to the voltage level of the battery of each solar powered illuminated boat cleat to the main controller.

* * * * *